US008087886B2

(12) United States Patent
Lin

(10) Patent No.: US 8,087,886 B2
(45) Date of Patent: Jan. 3, 2012

(54) SECTIONAL FAN FRAME STRUCTURE

(75) Inventor: Chun-Ju Lin, Taipei County (TW)

(73) Assignee: Tek-Chain Technology Co., Ltd., Taoyuan (TW)

( * ) Notice: Subject to any disclaimer, the term of this patent is extended or adjusted under 35 U.S.C. 154(b) by 1148 days.

(21) Appl. No.: 11/808,793

(22) Filed: Jun. 13, 2007

(65) Prior Publication Data

US 2008/0310952 A1 Dec. 18, 2008

(51) Int. Cl.
*F04D 29/52* (2006.01)

(52) U.S. Cl. ..... 415/214.1; 415/220

(58) Field of Classification Search ..... 415/196, 415/197, 214.1, 220, 224
See application file for complete search history.

(56) References Cited

U.S. PATENT DOCUMENTS

| | | | | |
|---|---|---|---|---|
| 2,650,020 | A * | 8/1953 | Morrill | 415/223 |
| 2,650,021 | A * | 8/1953 | Morrill | 415/223 |
| 3,204,546 | A * | 9/1965 | Krell | 454/272 |
| 3,976,393 | A * | 8/1976 | Larson | 415/119 |
| 4,394,111 | A * | 7/1983 | Wiese et al. | 417/360 |
| 5,407,324 | A * | 4/1995 | Starnes et al. | 415/208.5 |
| 6,293,753 | B1 * | 9/2001 | Pal et al. | 415/221 |
| 6,547,540 | B1 * | 4/2003 | Horng et al. | 417/423.14 |
| 6,857,850 | B2 * | 2/2005 | Poock | 415/220 |
| 7,604,459 | B2 * | 10/2009 | Horng et al. | 415/214.1 |
| 2006/0028796 | A1 * | 2/2006 | Li et al. | 361/690 |

* cited by examiner

*Primary Examiner* — Nathaniel Wiehe
(74) *Attorney, Agent, or Firm* — Chun-Ming Shih; HDLS IPR Services

(57) ABSTRACT

The present invention discloses a sectional fan frame structure composed of two units or two units and a circular plate frame. The units can be made in different shapes as needed, and the units come with fasteners. The circular plate frame is formed by enclosing a plate, and the fasteners are installed at the positions of connecting the circular plate frame and the units. Therefore, a fan frame can be assembled by the latch of fasteners between the units, or the unit and the circular plate frame, so as to achieve the effects of simplifying the development of a mold, providing an easy demold after an injection molding, assembling a fan frame with a different height by changing the width of the circular plate frame, and saving the cost of the mold.

17 Claims, 11 Drawing Sheets

SECTIONAL FAN FRAME STRUCTURE

BACKGROUND OF THE INVENTION

1. Field of the Invention

The present invention relates to a sectional fan frame structure, and more particularly to a fan frame structure formed by connecting a unit with another unit or a unit with a circular plate frame, and a fan frame with a different height can be achieved by changing the width of the circular frame, and thus the cost for developing a mold can be saved.

2. Description of the Related Art

In the application of a conventional axial-flow fan, vanes are installed in a fan frame assembly. The fan frame assembly is divided into two main types: a single-layer fan frame assembly and a double-layer fan frame assembly. Although the single-layer fan frame assembly comes with a simple structure, the single-layer fan frame assembly is usually installed at a hidden position inside a casing due to its non-stylish appearance. In FIG. 1, the double-layer fan frame assembly has a more stylish appearance, and thus it can be installed in a casing as well as on a desk top. However, both sides of the double-layer fan frame assembly have a separated fan frame 1, two fan frame bodies connected to the fan frame 1 and tapered inward. Obviously, the development of such mold incurs a complicated process and a high cost. Since the mold is manufactured and formed integrally by a mold injection method, therefore the demold is relatively difficult. Furthermore, it is necessary to design and develop the mold again. Although vanes generally come with a standard diameter, yet the height of the fan frame bodies 2 varies to cope with a different curvature of the vanes and the development of new products. In addition to the cost of developing the mold, the time to market is delayed, and such conventional way of developing a fan is definitely not suitable.

In view of the foregoing shortcomings of the prior art, the inventor of the present invention based on years of experience in the related industry to conduct extensive researches and experiments to overcome the shortcomings of the prior art, and finally developed a sectional fan frame structure in accordance with the present invention.

SUMMARY OF THE INVENTION

The primary objective of the present invention is to provide a sectional fan frame structure comprised of two units or two units and a circular plate frame for simplifying the development of a mold and providing an easily demold after an injection molding.

Another objective of the present invention is to provide a sectional fan frame structure in conformity with vanes of a different curvature, and the width of a circular plate frame can be changed by increasing the height of a fan frame without resigning the fan frame assembly.

A further objective of the present invention is to provide a sectional fan frame structure, wherein the units or the circular plate frame have corresponding fasteners disposed at specific positions for assembling the units or the unit and the circular plate frame sequentially, such that the units or the circular plate frame can be fixed by the fasteners to form a fan frame.

DETAILED DESCRIPTION OF THE PREFERRED EMBODIMENTS

Figure 1:
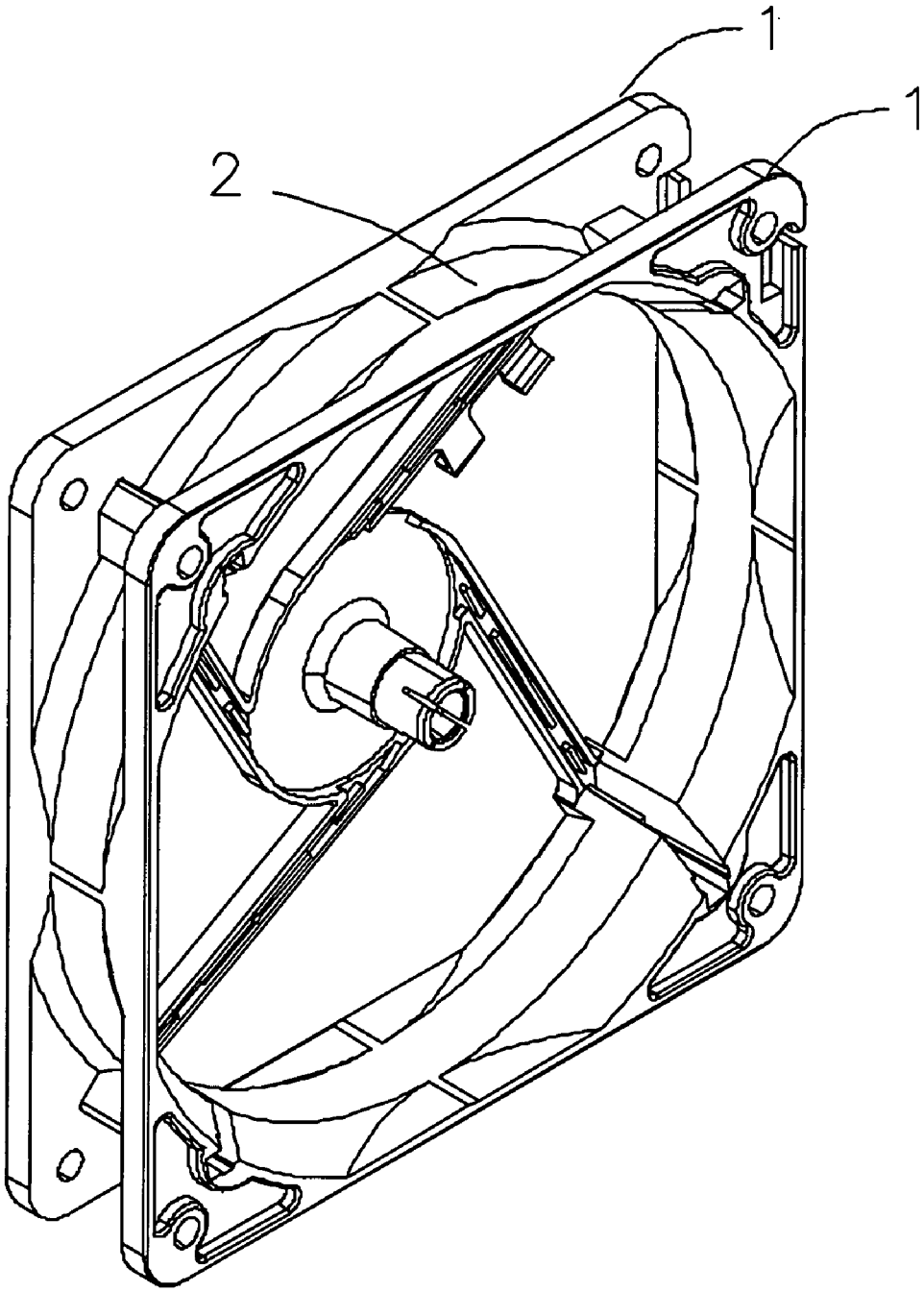
FIG. 1 (PRIOR ART)
FIG. 1 is a perspective view of a conventional structure.
Figure 2:
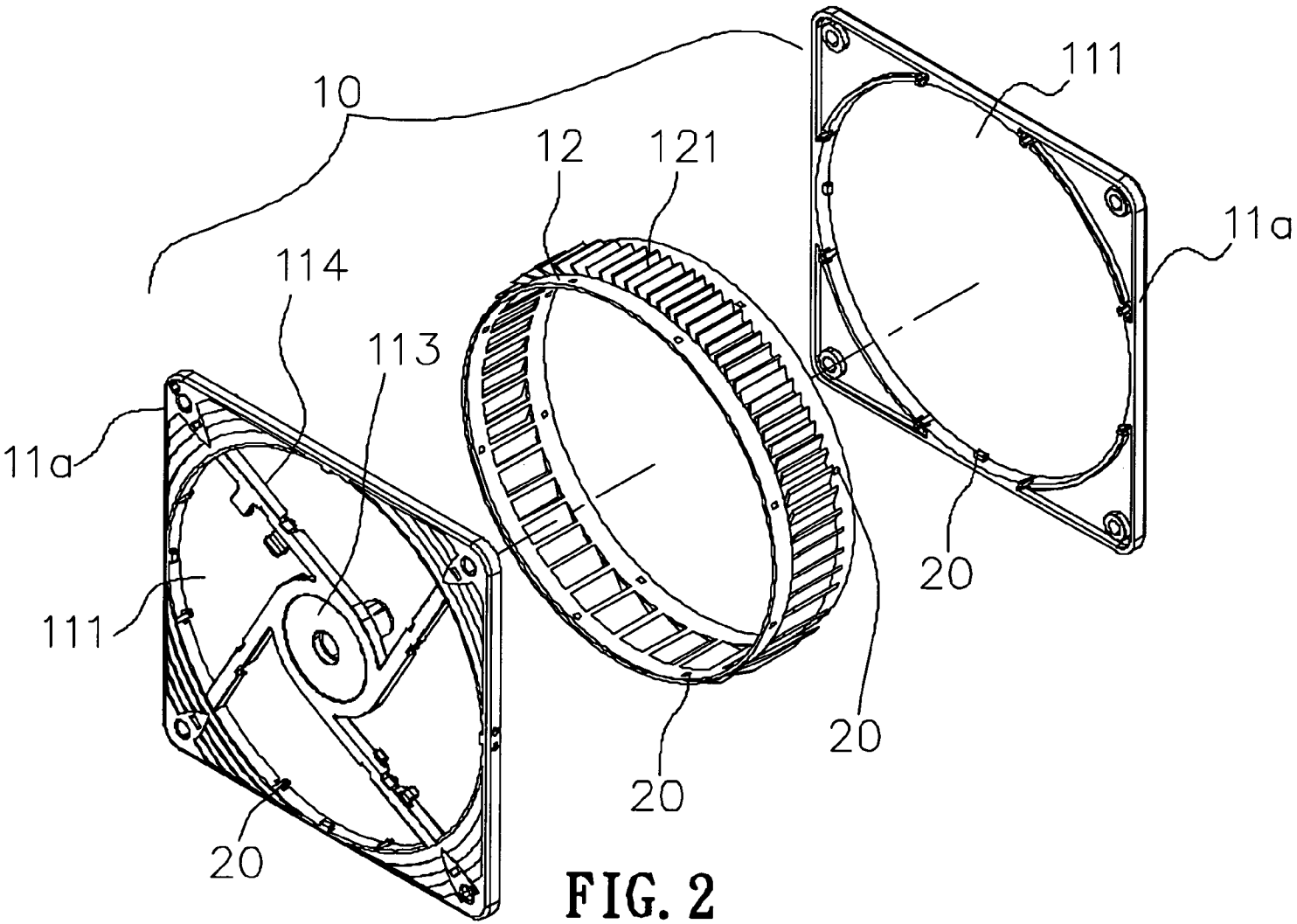
FIG. 2 is a perspective view of a first preferred embodiment of the present invention.

To make it easier for our examiner to understand the present invention, the following detailed description with reference to the accompanying drawings of embodiments are given for example, but such preferred embodiments are not intended to limit the scope of the present invention. For simplicity, like numerals are used for like elements for the description of the specification of the present invention.

Referring to FIGS. 2, 3, 3A, 4, 4A for a sectional fan frame structure of a first preferred embodiment of the present invention, the structure comprises a fan frame 10, and the fan frame 10 is composed of two units 11*a* and a circular plate frame 12, and the units 11*a* are rectangular frame bases (but ordinary persons skilled in the art can substitute it with a frame base of another shape), and each unit 11*a* has a circular opening 111 and a fastener 20 disposed on a specific position of the unit 11*a*, and the fastener 20 can be a hook or an embedding groove, and an axle seat 113 is connected to the middle of the opening 111 of one of the units 11*a* through a rib 114, and the axle seat 113 has a circuit (not shown in the figure) for turning on the fan. The circular plate frame 12 is formed by enclosing a rectangular plate, and a fastener 20 is disposed separately on both sides of the circular plate frame 12, and the fasteners 20 are latched to the corresponding positions of the fasteners 20 of the units 11*a*. Further, the circular plate frame 12 has a plurality of protrusions 121 integrally formed with the circular plate frame 12 by a punching method, and at least one side of the protrusion 121 is connected to the circular plate frame 12, such that the protrusions 121 can provide an air flow guide effect to the wind entering the fan frame 10.

Figure 3:
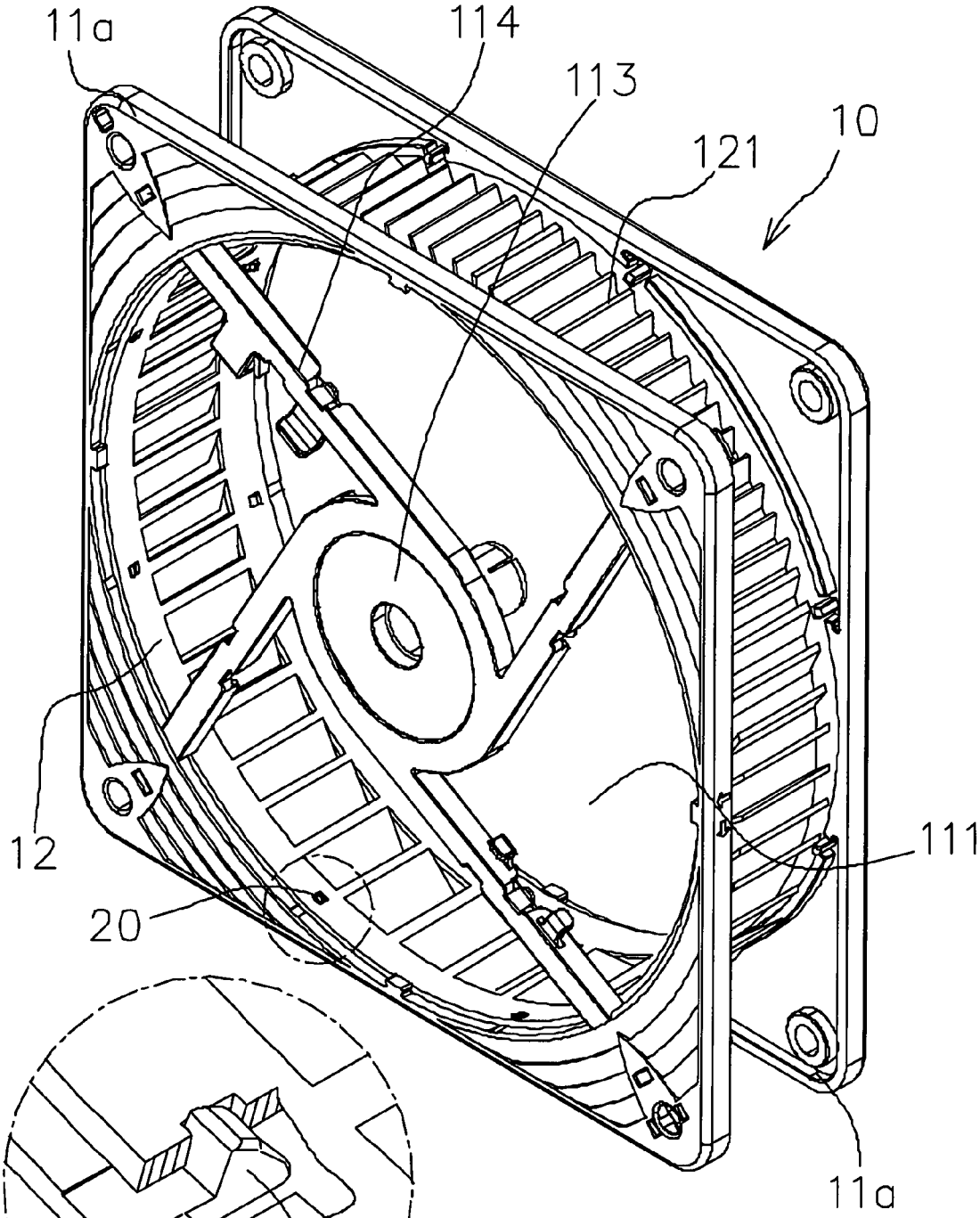
FIG. 3 is a perspective view of a first preferred embodiment of the present invention.
Figure 3A:
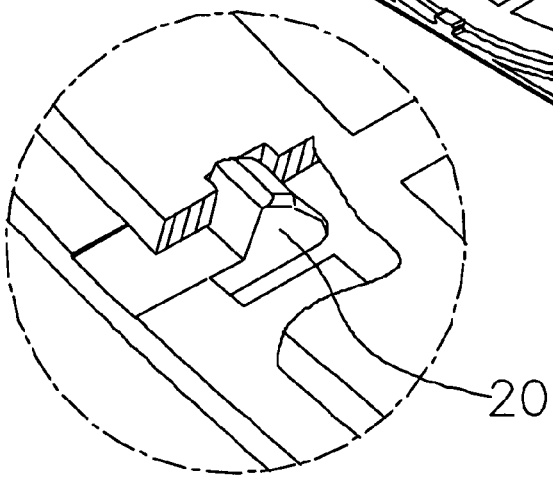
FIG. 3A is an enlarged view of a latch in accordance with a first preferred embodiment of the present invention.
Figure 4:
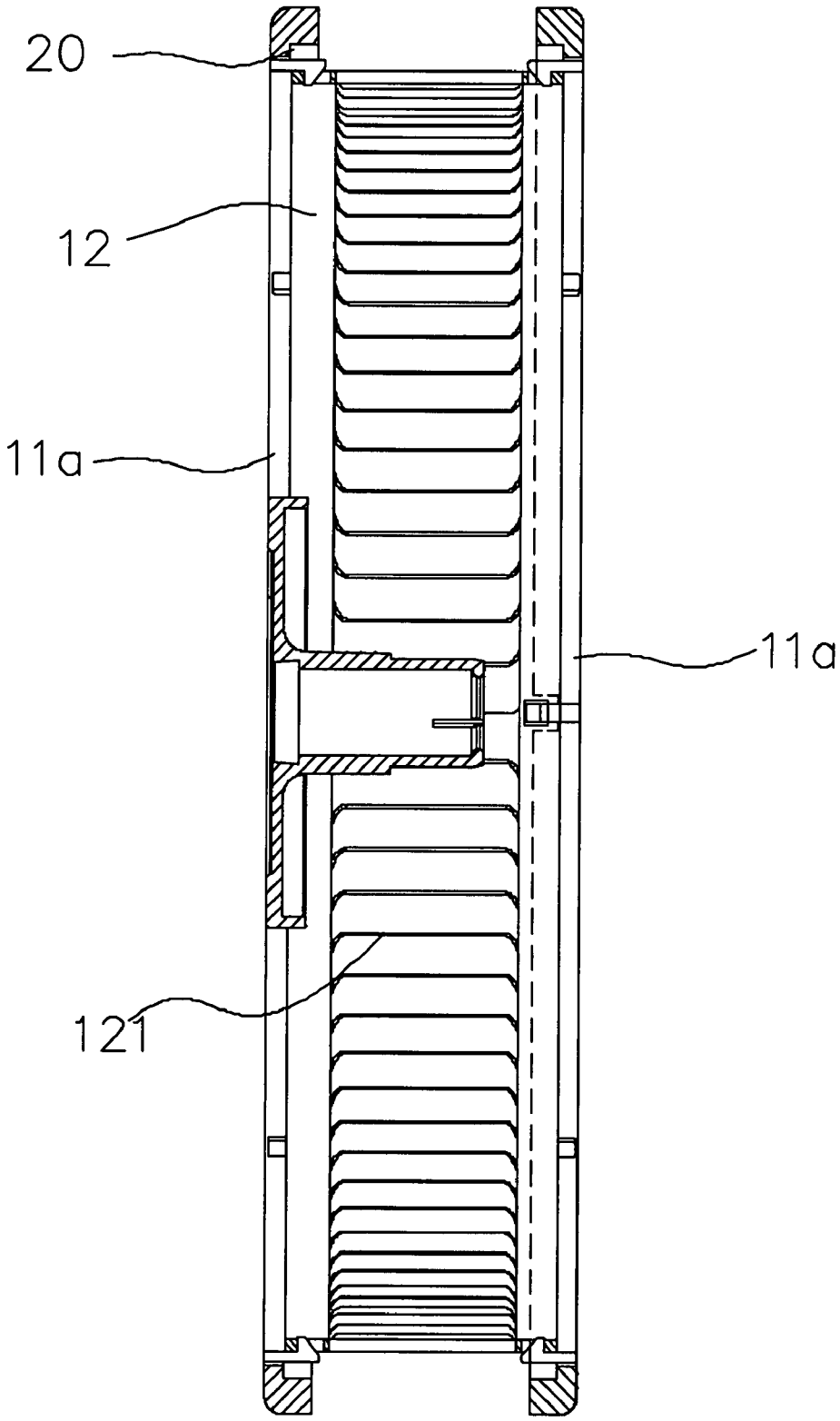
FIG. 4 is a schematic sectional view of a first preferred embodiment of the present invention.
Figure 4A:
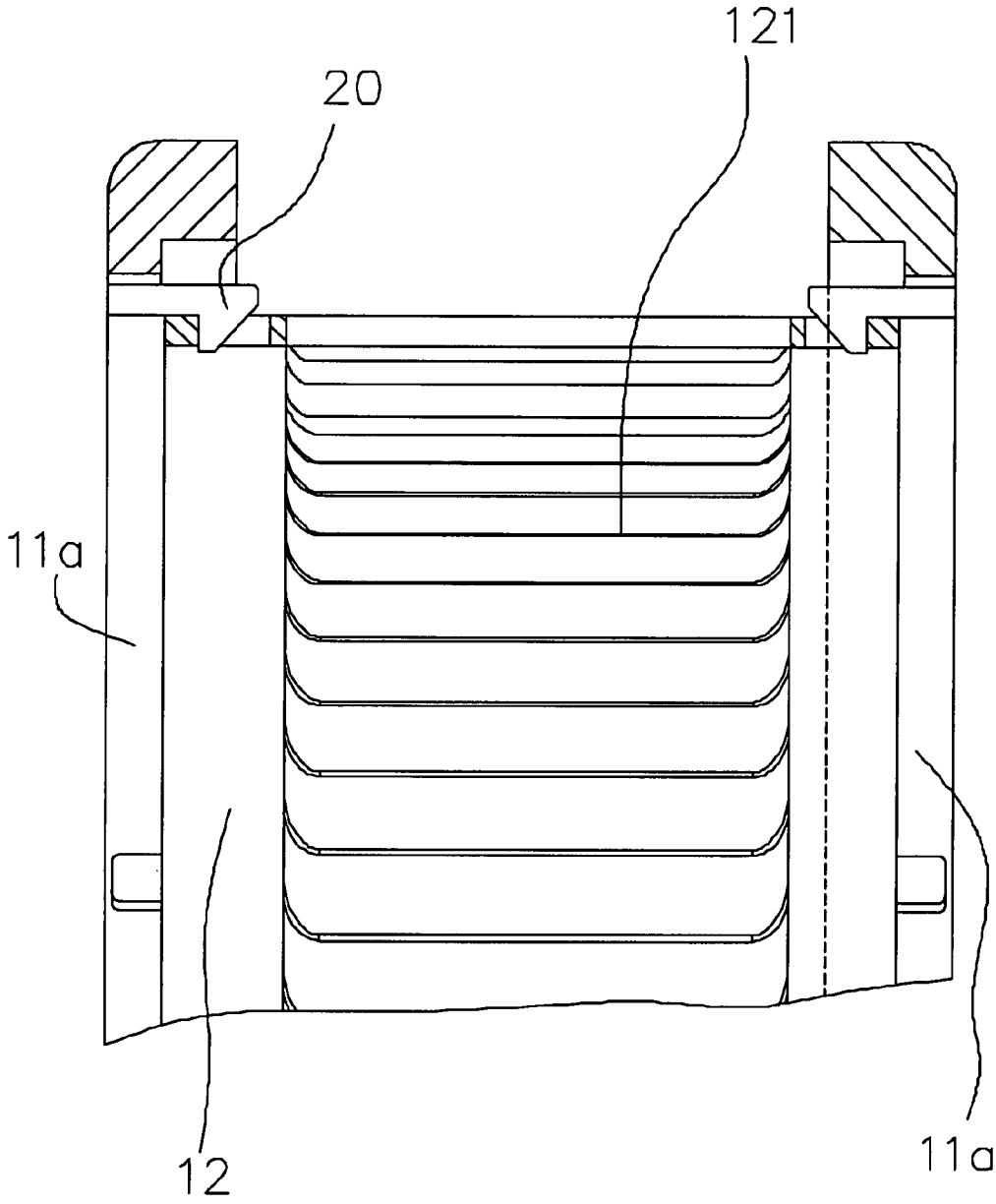
FIG. 4A is a schematic sectional view of a latch in accordance with a first preferred embodiment of the present invention.

During the assembling process, the units 11*a* are disposed respectively on both sides of the circular plate frame 12, and the fasteners 20 of the circular plate frame 12 are latched with the fasteners 20 of the units 11*a* (as shown in FIGS. 3 and 3*a*), such that the units 11*a*, the circular plate frame 12 and the fasteners 20 are connected to form a fan frame.

Figure 5:
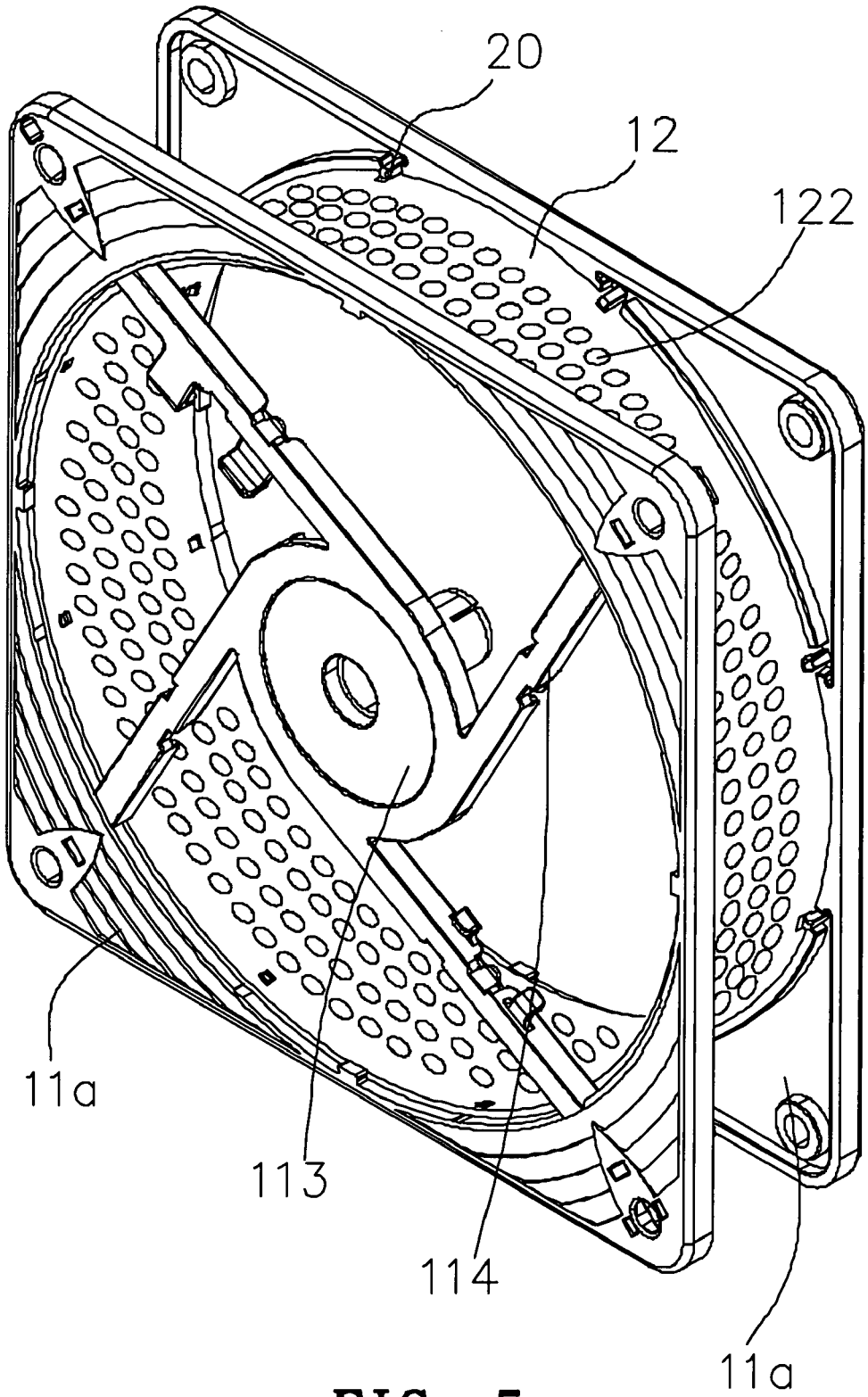
FIG. 5 is a perspective view of a second preferred embodiment of the present invention.

Referring to FIG. 5 for a second preferred embodiment of the present invention, the structure comprises a fan frame 10 composed of two units 11*a* and a circular plate frame 12. The main difference between this preferred embodiment and the first preferred embodiment resides in that the circular plate frame 12 has a plurality of punched holes 122 (which can be punched into different shapes or words). With the punched holes 122, the airflow is increased during the operation of the fan.

Figure 6:
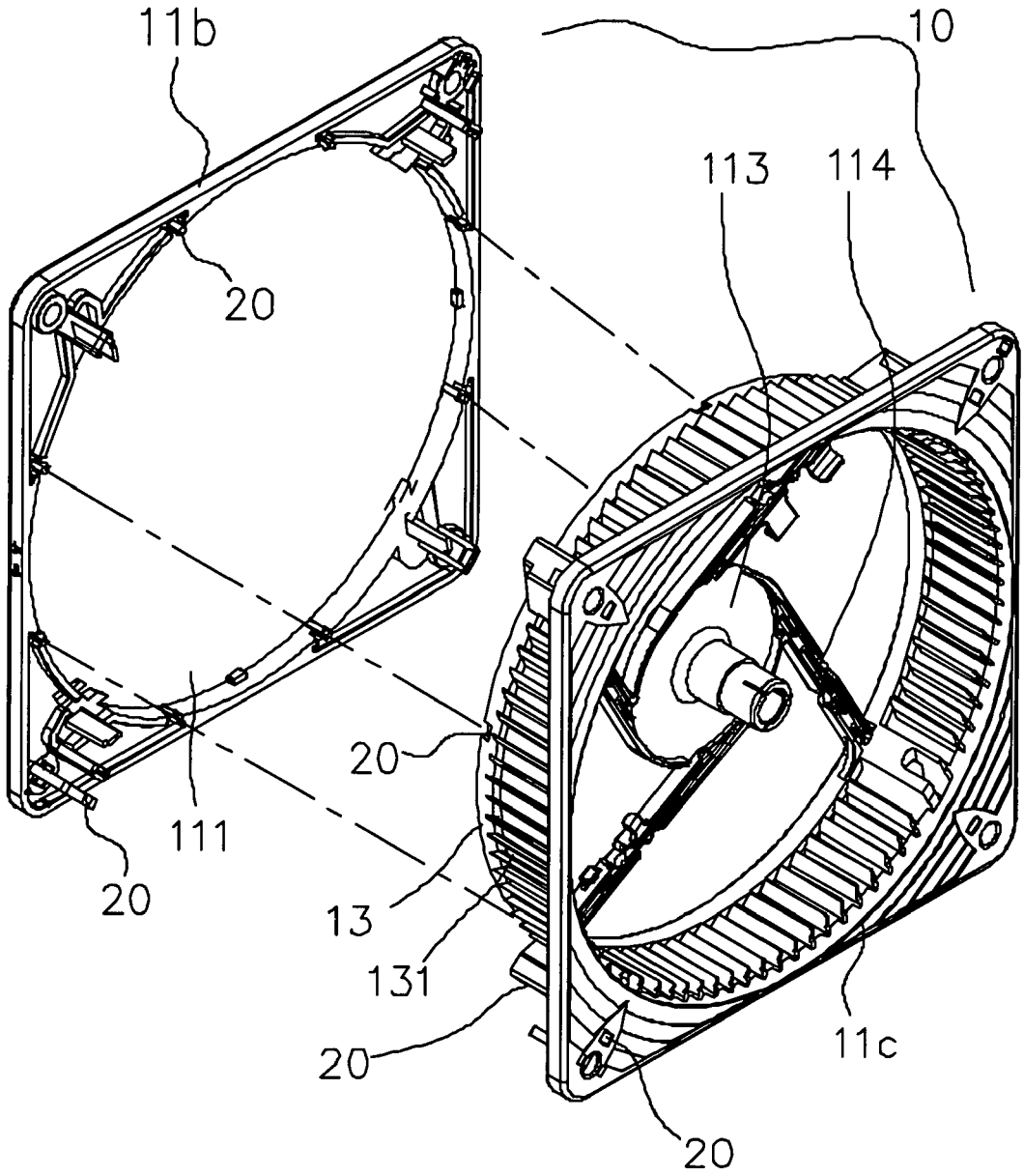
FIG. 6 is an exploded view of a third preferred embodiment of the present invention.

Referring to FIG. 6 for a third preferred embodiment of the present invention, the structure comprises a fan frame 10 composed of a first unit 11*b* and a second unit 11*c*, and the first and second units 11*b*, 11*c* are rectangular frame bases (but ordinary persons skilled in the art can substitute it with a frame base of another shape), and the first and second units 11*b*, 11*c* separately have a circular opening 111, and a fastener 20 disposed at a specific position of the first and second units 11*b*, 11*c*. The fastener can be a hook or an embedding groove, which is disposed separately on an edge of the opening 111 and each distal edge of the first and second units 11*b*, 11*c*, and the second unit 11*c* is an integrally formed circular fixing frame 13, and the circular fixing frame 13 comes with a specific height, and the circular fixing frame 13 of the second unit 11*c* has a fastener 20, and the position of the fastener 20 corresponds to the position of the fastener 20 of the first unit 11*b*, and the circular fixing frame 13 has a plurality of protrusions 131 integrally formed with the circular fixing frame 13 by a punching method, and at least one side of the protrusion 131 is connected with the circular fixing frame 13. Further, the second unit 11*c* has an axle seat 113 disposed at an end without being connected to the circular fixing frame 13, and the axle seat 113 has a circuit (not shown in the figure) for turning on the fan. Further, a rib 114 is disposed at the periphery of the axle seat 113 and connected to the circular fixing frame 13.

Figure 7:
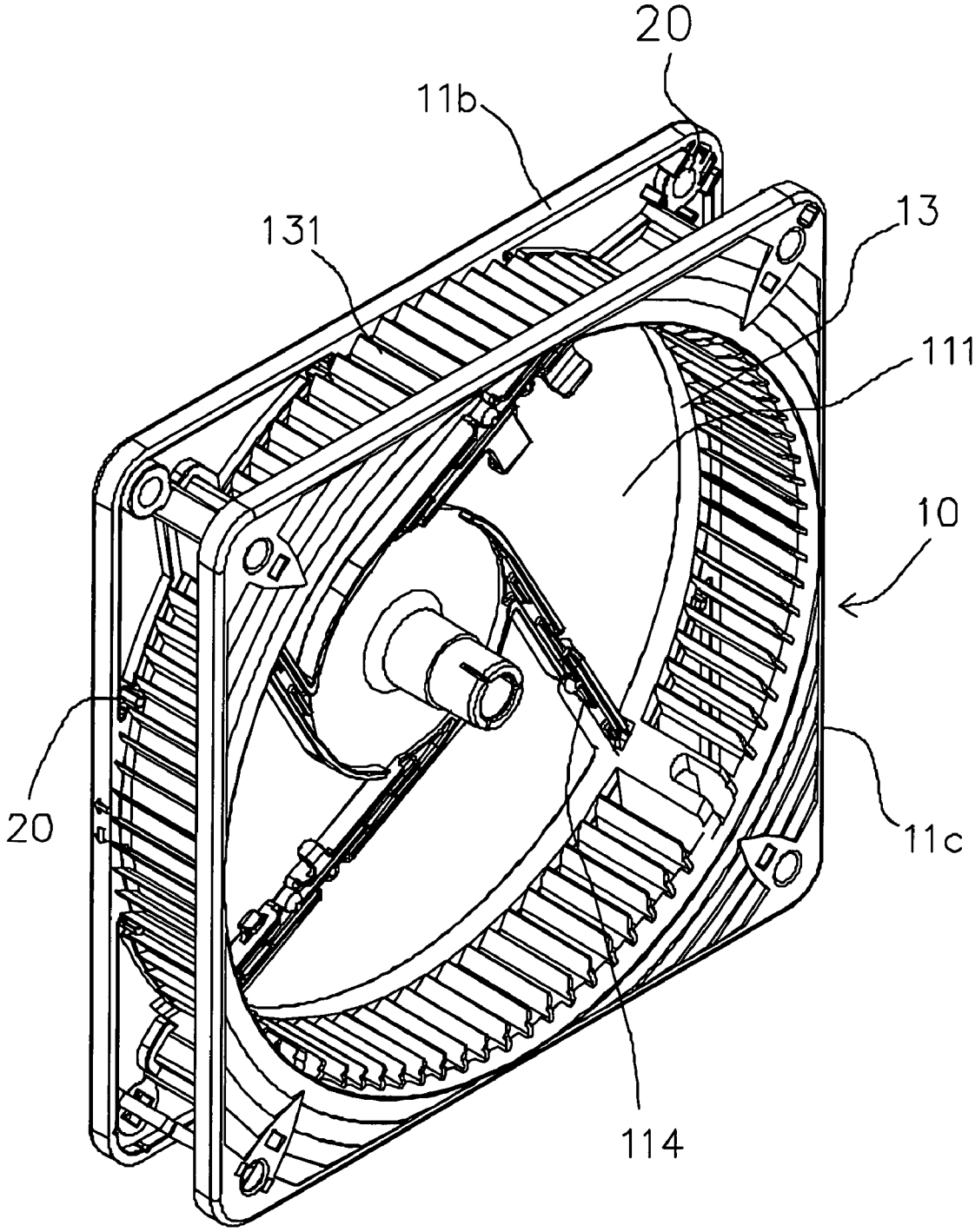
FIG. 7 is a perspective view of a third preferred embodiment of the present invention.

During the assembling process, the first unit 11*b* is in contact with a circular fixing frame 13 on the second unit 11*c*, and then the fasteners 20 of the first unit 11*b* are latched with the fasteners 20 of the second unit 11*c* and the circular fixing frame 13, such that the first and second units 11*b*, 11*c* are connected to form a fan frame (as shown in FIG. 7).

Figure 8:
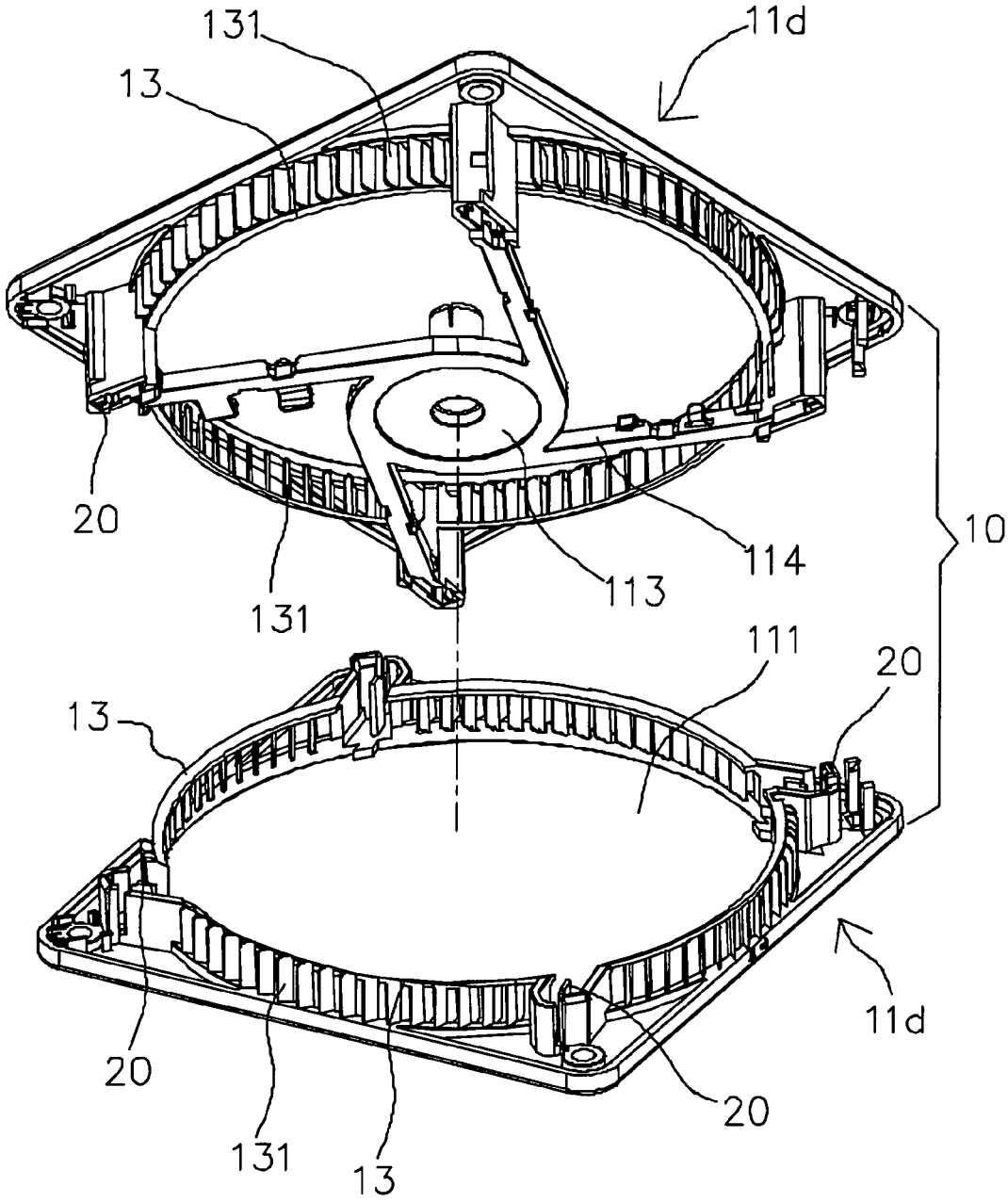
FIG. 8 is an exploded view of a fourth preferred embodiment of the present invention.

Referring to FIG. 8 for a fourth preferred embodiment of the present invention, the structure is a fan frame 10 composed of two units 11*d* integrally formed with the circular fixing frame 13 to constitute a rectangular frame base, and the circular fixing frame 13 has a specific height, and the circular fixing frame 13 has a plurality of protrusions 131 integrally formed with the circular fixing frame 13 by a punching method, and at least one side of the protrusion 131 is connected to the circular fixing frame 13, and the units 11*d* and the circular fixing frame 13 have corresponding fasteners 20, which can be hooks or embedding grooves. Further, an axle seat 113 is connected to one of the units 11*d*, and the axle seat 113 has a circuit (not shown in the figure) for turning on the fan, and a rib 114 is disposed at the periphery of the axle seat 113 and connected to the circular fixing frame 13.

Figure 9:
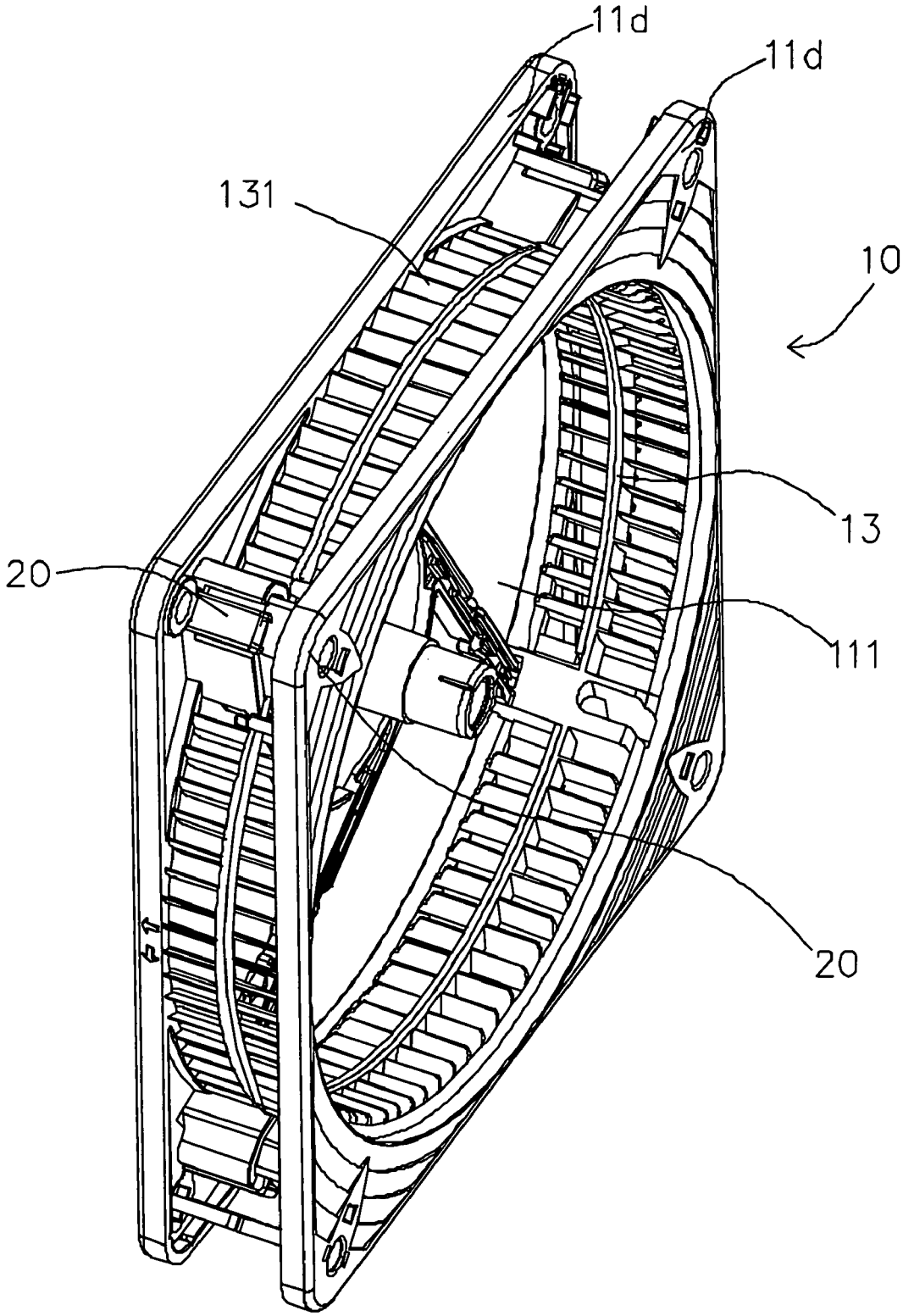
FIG. 9 is a perspective view of a fourth preferred embodiment of the present invention.

During the assembling process, the fastener 20 of a unit 11*d* is latched with the fastener 20 of another unit 11*d* (as shown in FIG. 9), so that the two units 11*d* are connected to form a fan frame 10, and the protrusions 131 of the circular fixing frame 13 are interlaced or included between the units 11*d*.

Figure 10:
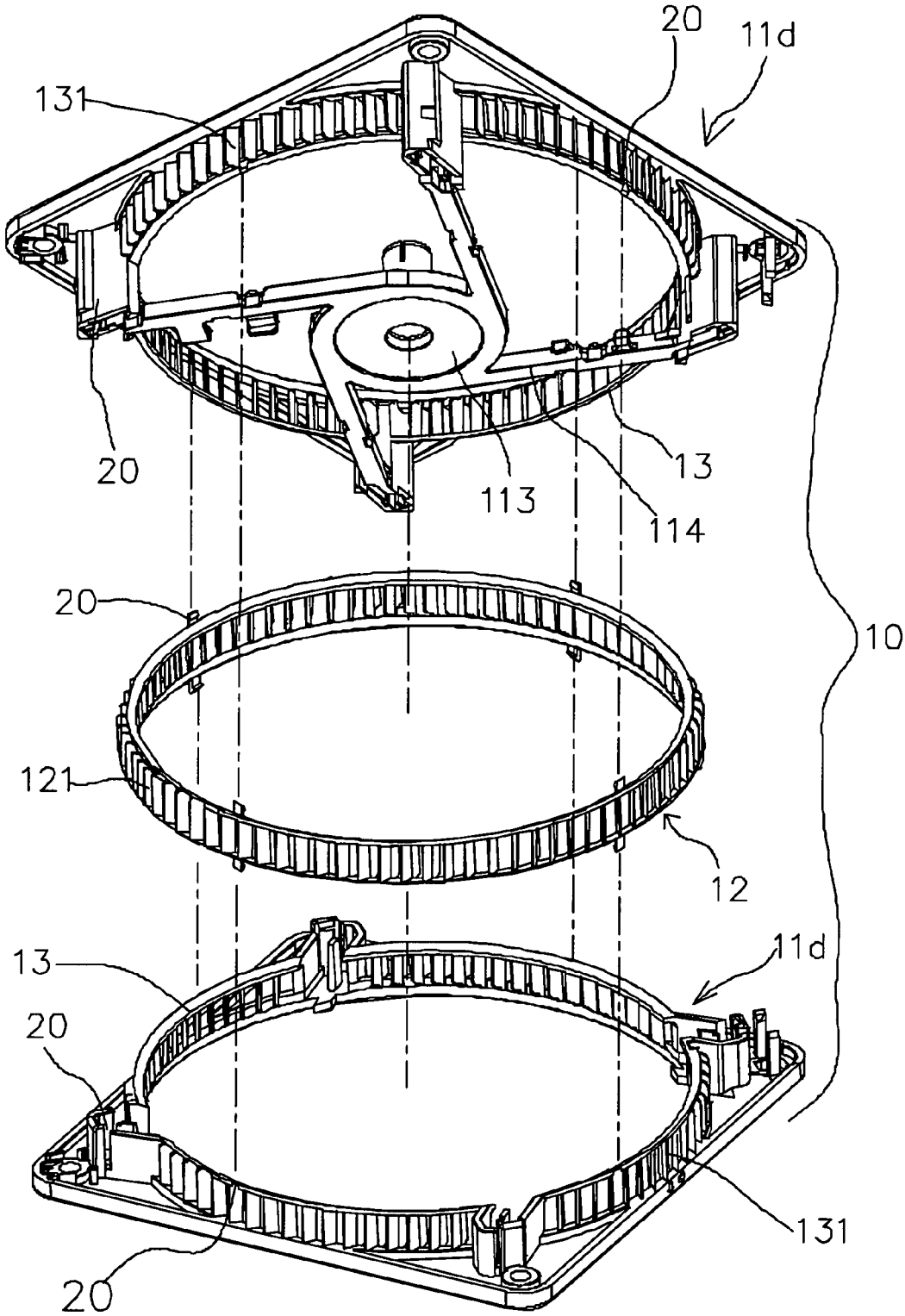
FIG. 10 is an exploded view of a fifth preferred embodiment of the present invention.

Referring to FIG. 10 for a fifth preferred embodiment of the present invention, the structure is a fan frame 10 composed of two units 11*d* and a circular plate frame 12, and the units 11*d* are integrally formed with a circular fixing frame 13 to form a rectangular frame base (but ordinary persons skilled in the art can substitute it with a frame base of another shape), and the circular fixing frame 13 comes with a specific height, and an axle seat 113 is disposed and connected to one of the units 11*d* and has a circuit (not shown in the figure) for turning on the fan. Further, a rib 114 is disposed at the periphery of the axle seat 113 and connected to the circular fixing frame 13. The circular plate frame 12 is formed by enclosing a rectangular plate, and a fastener 20 is disposed separately on both sides of the circular plate frame 12 and the fastener 20 can be a hook or an embedding groove, and the fasteners 20 are latched to the positions of the corresponding fasteners 20 on both sides of the unit 11*d*. Further the circular fixing frame 13 and the circular plate frame 12 of the unit 11*d* have a plurality of protrusions 131, 121, and the protrusions 131, 121 are integrally formed with the circular fixing frame 13 and the circular plate frame 12 respectively by a punching method, and at least one side of the protrusions 131, 121 is connected to the circular fixing frame 13 and the circular plate frame 12, such that the protrusions 131, 121 can provide an air flow guide effect to the wind entering the fan frame.

During the assembling process, the fasteners 20 of the unit 11*d* are latched to connect the aforementioned three components, such that the circular plate frame 12 is included in the unit 11*d* to form a fan frame 10, and the protrusions 131, 121 of the circular fixing frame 13 and the circular plate frame 12 are interlaced or corresponding to each other, and the height of the fan frame 10 can be adjusted by changing the quantity of circular plate frames 12.

Therefore, the units or circular frames can be manufactured into different shapes according to different requirements or designs, so as to simplify the development of a mold and provide an easy mold after an injection molding. In the meantime, a fan frame of a different height can be achieved by changing the width of the circular frame, and thus the invention can save the cost of the mold.

In summation of the description above, the present invention enhances the prior art and also complies with the patent application requirements. The description and its accompanied drawings are used for describing preferred embodiments of the present invention, and it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A sectional fan frame structure, comprising:

a first and a second frame units separately formed, each having an opening and a first fastener disposed on an edge of the opening; and a circular frame separately formed with respect to the first and the second frame units, having a predetermined height and a second fastener disposed on each of both sides of the circular frame engage with the first fastener;

thereby, the first and the second frame units are installed on the both sides of the circular frame respectively by the first and the second fasteners to form a fan frame, and the predetermined height of the circular frame determines a height of the fan frame.

2. The sectional fan frame structure as recited in claim 1, wherein the first frame unit includes a rib extended towards the center of the opening, an axle seat is coupled to the rib, and the axle seat includes a circuit disposed thereon for turning on a fan.

3. The sectional fan frame structure as recited in claim 2, wherein the circular frame includes a plurality of penetrating punched holes for increasing incoming airflow when the fan is operating.

4. The sectional fan frame structure as recited in claim 3, wherein the punched hole is in a discrete or a continuous circular, elliptic or polygonal shape.

5. The sectional fan frame structure as recited in claim 1, wherein the first fastener is a latch or an embedding groove.

6. The sectional fan frame structure as recited in claim 1, wherein the circular frame includes a plurality of partially cutout protrusions with at least one side of each protrusion extending from the circular frame, such that the protrusions provide an air flow guide effect for wind entering the fan frame.

7. A sectional fan frame structure, comprising:

a one-piece first frame unit integrally formed with a first circular fixing frame;

a one-piece second frame unit integrally formed with a second circular fixing frame; and a circular frame installed between the first and the second frame units and having a predetermined height, a first fastener being disposed on one side of the first circular fixing frame, a second fastener being disposed on one side of the second circular fixing frame, and a third and a fourth fasteners being disposed separately on both sides of the circular frame to engage with the first fastener of the first circular fixing frame and the second fastener of the second circular fixing frame, respectively, so as to increase the height of the fan frame;

thereby, the first and the second frame units and the circular frame are installed together to form a fan frame.

8. The sectional fan frame structure as recited in claim 7, wherein the first circular fixing frame includes a rib extended towards the center thereof, an axle seat is coupled to the rib, and the axle seat includes a circuit disposed thereon for turning on a fan.

9. The sectional fan frame structure as recited in claim 7, wherein each of the first and the second circular fixing frames includes a plurality of partially cutout protrusions with at least one side of each protrusion extending from each of the first and the second circular plate frames, such that the protrusions provide an air flow guide effect for wind entering the fan frame.

10. The sectional fan frame structure as recited in claim 7, wherein the circular frame includes a plurality of partially cutout protrusions with at least one side of each protrusion extending from the circular frame, such that the protrusions provide an air flow guide effect for wind entering the fan frame.

11. The sectional fan frame structure as recited in claim 7, wherein the first and the second fasteners are corresponding hook and embedding groove.

12. The sectional fan frame structure as recited in claim 7, wherein the third and fourth fasteners are corresponding hook and embedding groove.

13. A sectional fan frame structure, comprising:

a first frame unit, having an opening and a first fastener disposed on an edge of the opening; and a one-piece second frame unit integrally formed with a circular fixing frame, the circular fixing frame having a second fastener disposed on one side thereof to engage with the first fastener; such that the first frame unit is fixed to the circular fixing frame of the second frame unit by the first and the second fasteners to form a fan frame.

14. The sectional fan frame structure as recited in claim 13, wherein the circular fixing frame has a rib extended towards the center thereof, an axle seat is coupled to the rib, and the axle seat includes a circuit for starting a fan.

15. The sectional fan frame structure as recited in claim 14, wherein the circular fixing frame includes a plurality of penetrating punched holes for increasing airflow during the operation of the fan.

16. The sectional fan frame structure as recited in claim 13, wherein each of the first and the second fasteners is a latch or an embedding groove.

17. The sectional fan frame structure as recited in claim 13, wherein the circular fixing frame includes a plurality of partially cutout protrusions with at least one side of each protrusion extending from the circular fixing frame, such that the protrusions allow an air guide effect for wind entering into the fan frame.

* * * * *